US006476710B2

(12) United States Patent
Togawa et al.

(10) Patent No.: US 6,476,710 B2
(45) Date of Patent: Nov. 5, 2002

(54) ELECTROMAGNETIC SOUND GENERATOR

(75) Inventors: Shinichi Togawa, Yamanashi-ken (JP); Masato Asahina, Yamanashi-ken (JP); Yoshizumi Ohta, Yamanashi-ken (JP)

(73) Assignee: Citizen Electronics Co., Ltd., Yamanashi-ken (JP)

( * ) Notice: Subject to any disclaimer, the term of this patent is extended or adjusted under 35 U.S.C. 154(b) by 0 days.

(21) Appl. No.: 09/837,369

(22) Filed: Apr. 19, 2001

(65) Prior Publication Data

US 2001/0033224 A1 Oct. 25, 2001

(30) Foreign Application Priority Data

Apr. 24, 2000 (JP) ..... 2000-123035

(51) Int. Cl.[7] ..... G08B 3/00

(52) U.S. Cl. ..... 340/384.1; 340/388.1; 340/391.1; 381/396

(58) Field of Search ..... 340/384.1, 388.1, 340/391.1, 407.1; 381/396, 431; 368/243

(56) References Cited

U.S. PATENT DOCUMENTS 3,774,200 A * 11/1973 Heath ..... 340/384.1
3,869,855 A * 3/1975 Sodler ..... 368/243
5,287,084 A * 2/1994 Sone ..... 340/388.4
5,878,149 A * 3/1999 Hamada et al. ..... 381/340
5,894,263 A * 4/1999 Shimakawa et al. ..... 340/388.1
6,023,518 A * 2/2000 Kuwabara et al. ..... 381/396
6,208,238 B1 * 3/2001 Ohta ..... 340/391.1
6,265,965 B1 * 7/2001 Lee ..... 340/388.1

* cited by examiner

*Primary Examiner*—John Tweel
(74) *Attorney, Agent, or Firm*—Dennison, Schultz & Dougherty

(57) ABSTRACT

An electromagnetic sound generator has a case provided with a yoke, a magnet, a vibrating plate and a coil, and a pair of leads. An end of the coil and the other end of the leads is secured to the case so as to be connected to an outside terminal. A terminal connecting device is provided for connecting the end of the lead to the outside terminal. The terminal connecting device comprises a cylindrical case secured to the case, a connecting rod slidably mounted in the cylindrical case, and a coil spring provided in the cylindrical case to outwardly urge the connecting rod so as to be contacted with the outside terminal at an end of the rod. A top end of the cylindrical case is contacted with the end of the lead.

3 Claims, 7 Drawing Sheets

ELECTROMAGNETIC SOUND GENERATOR

BACKGROUND OF THE INVENTION

The present invention relates to an electromagnetic sound generator for generating sounds by vibrating a vibration plate by an electromagnet, and more particularly to an electromagnetic sound generator mounted on a printed circuit board by the surface mount technology.

In recent years, there is a tendency to mount small electric parts on a printed circuit board, the electromagnetic sound generator as a small buzzer is accordingly mounted on the printed circuit board. Such a printed circuit with the electromagnetic circuit board is used as a signaling device of the portable telephone and beeper.

Referring to FIGS. 5 and 6, which are a plan view of a conventional electromagnetic sound generator and a sectional view taken along a line A—A of FIG. 5 respectively, a case 50 of the electromagnetic sound generator comprises a lower case 51 and an upper case 52.

The lower case 51 has a circular bottom 51*d* and a cubic portion 51*e*. An annular projection 51*a* is formed on the lower case 51 and a pair of cylindrical projections 51*f*, each having a hole 51*b* are formed in the cubic portion 51*e*.

A yoke 53 made of magnetic material is secured to the bottom 51*c*. A core 53*a* is formed at a central portion of the yoke 53 and a notch 53*b* is formed at a side of the yoke. An annular magnet 55 and a coil 54 are mounted on the yoke 53. An annular vibrating plate 56 having an armature 57 is secured on the annular projection 51*a*. Thus, a magnetic circuit for a buzzer is formed by the yoke 53, core 53*a*, magnet 55, and vibrating plate 56.

A pair of lead plates 58, each of which is made of an elongated metal plate, are embedded in the lower case 51. Each of the lead plates 58 is extended between a side wall of the lower case 51 adjacent the hole 51*b* and an end 58*a* exposed in the notch 53*b* of the yoke 53. A coil spring 59 is inserted in each hole 51*b*. An upper end 59*a* (FIG. 7*a*) of the coil spring 59 is inserted in a hole 58*c* formed in an end portion 58*b* of the lead plate 58 and electrically connected to the lead plate 58 by solder 65 (FIG. 7*b*). The lower end of the spring 59 is projected from the underside of the lower case 51.

Both ends of the coil 54 are soldered to ends 58*a* of lead plates 58. Thus, the coil 54 is connected to the coil springs 59.

The upper case 52 has a sound emanating hole 50*a*. The upper case 52 is adhered to the lower case 51 so that a resonance room 66 is formed in the case 50.

Here, it is necessary to accurately assemble the coil spring 59 in the hole 51*b* so as not to contact with the inner wall of the hole 51*b*. FIGS. 7*a* and 7*b* are sectional views showing a method for assembling the coil spring. A positioning jig 70 is provided for positioning the lower case 51. The positioning jig 70 has a pair of positioning holes, each comprising a spring positioning hole 70*a* and a projection positioning hole 70*b*.

In the assembling of the coil spring 59, the lower case 51 is mounted on the jig 70, engaging the cylindrical projection 51*f* with the projection positioning hole 70*b* as shown in FIG. 7*a*. The coil spring 59 is inserted in the spring positioning hole 70*a* of the jig 70 and the hole 51*b* of the lower case 51. The upper end 59*a* of the coil spring 59 is inserted in the hole 58*c* of the end portion 58*b* of the lead plate 58 and the coil spring is compressed by a pressing jig 71. The upper end 59*a* of the coil spring 59 is connected to the end portion 58*b* by the solder 65 as shown in FIG. 7*b*.

Referring to FIG. 8*a*, the case 50 is mounted on a printed circuit board 81. The end of the coil spring 59 is pressed against a terminal on the circuit board 81 so that the electric current is applied to the coil 54 to vibrate the vibrating plate 56. The generated sound is emanated from the sound emanating hole 50*a*.

If the case 50 is inadvertently lifted and there is formed a gap G between the lower end of the cylindrical projection 51*f* and the printed circuit board 81 as shown in FIG. 8*b*, the coil spring 59 expands accordingly. Consequently, the connection between the coil spring and the circuit of the circuit board 81 is kept.

FIG. 9 is a sectional view showing a connecting portion of another conventional buzzer. A U-shaped connecting spring pate 62 is connected to a lead frame 61 secured to a case 60 of the buzzer by solder 63 at an end thereof. Another end of the spring plate 62 is pressed against a terminal of a printed circuit board 82.

When the case 60 is mounted on a circuit board 82, the connecting spring plate 62 is bent and the end of the plate is contacted with a terminal of the circuit board 82.

Therefore, if there is formed a gap between the case 60 and the circuit board 82, the contact of the spring plate 62 with the terminal is kept.

However, when each of the above described conventional sound generators falls and collides with a hard ground, the coil spring 59 or spring plate 62 disengages from the terminal. Furthermore, there must be provided a plurality of jigs for accurately soldering the coil spring or spring plate, which requires multiple manufacturing steps.

SUMMARY OF THE INVENTION

An object of the present invention is to provide an electromagnetic sound generator having an external connecting terminal structure which has a high reliability and may be simply manufactured without accuracy jigs.

According to the present invention, there is provided an electromagnetic sound generator having a case provided with a yoke, a magnet, a vibrating plate and a coil, and a pair of leads, wherein an end of each of the leads is connected to an end of the coil and the other end of the leads is secured to the case so as to be connected to an outside terminal, a terminal connecting device is provided for connecting the end of the lead to the outside terminal, the terminal connecting device comprises a cylindrical case secured to the case, a connecting rod slidably mounted in the cylindrical case, and a coil spring provided in the cylindrical case to outwardly urge the connecting rod so as to be contacted with the outside terminal at an end of the rod, and means for contacting the cylindrical case with the end of the lead.

The means is engagement of the cylindrical case with a inside wall of a hole formed in the case so as to keep the contact of the cylindrical case with the end of the lead.

The means comprises a ball provided with the cylindrical case so as to be outwardly urged by the coil spring to be contacted with an inside wall of a hole formed inn the end of the lead.

These and other objects and features of the present invention will become more apparent from the following detailed description with reference to the accompanying drawings.

DETAILED DESCRIPTION OF THE PREFERRED EMBODIMENT

Figure 1:
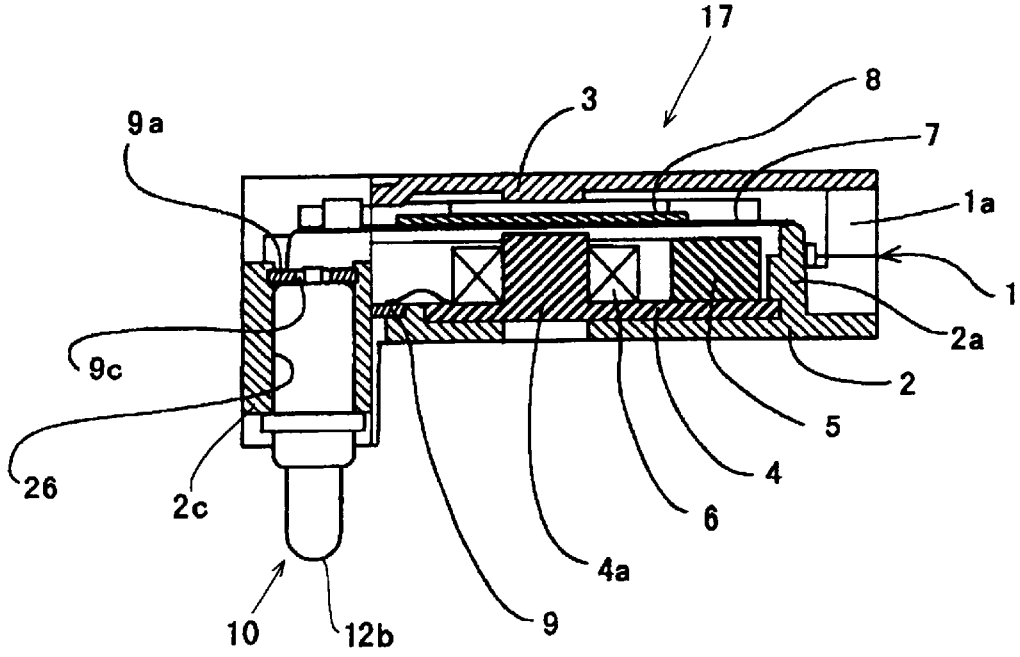
FIG. 1 is a sectional view of an electromagnetic sound generator according to the present invention.
Figure 5:
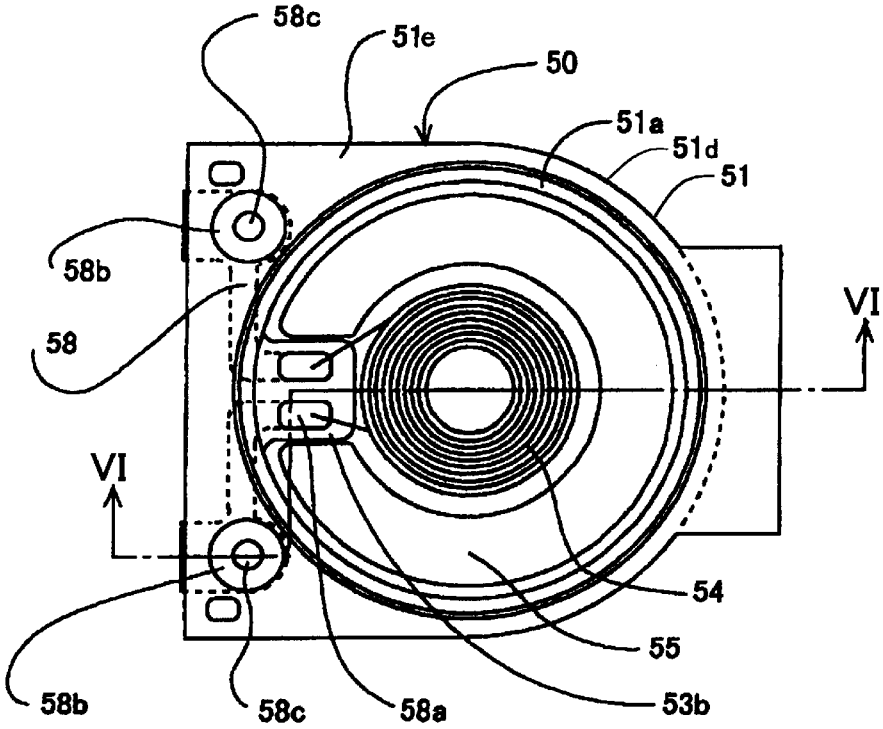
FIG. 5 PRIOR ART
FIG. 5 is a plan view of a conventional sound generator.
Figure 6:
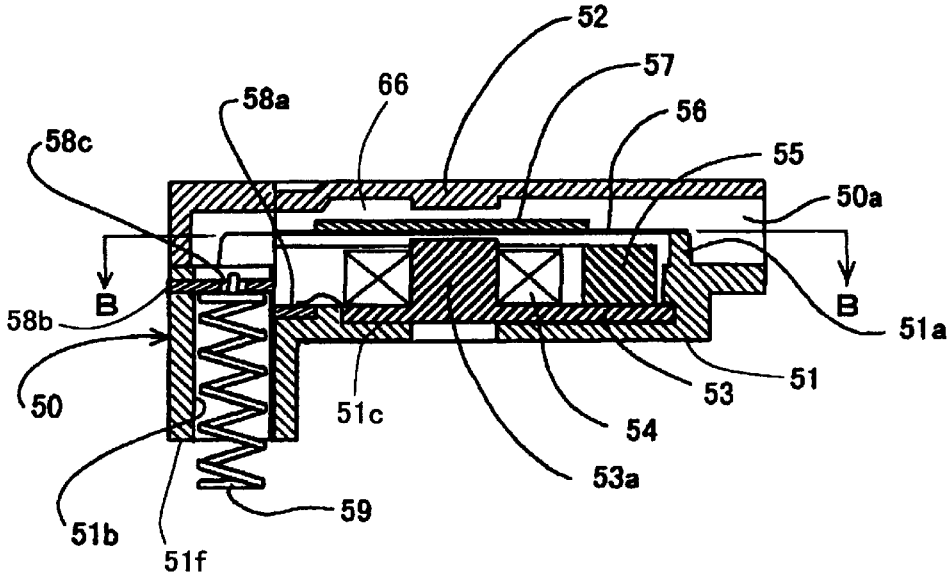
FIG. 6 PRIOR ART
FIG. 6 is a sectional view of the conventional sound generator taken along a line VI—VI of FIG. 5.
Figure 7A:
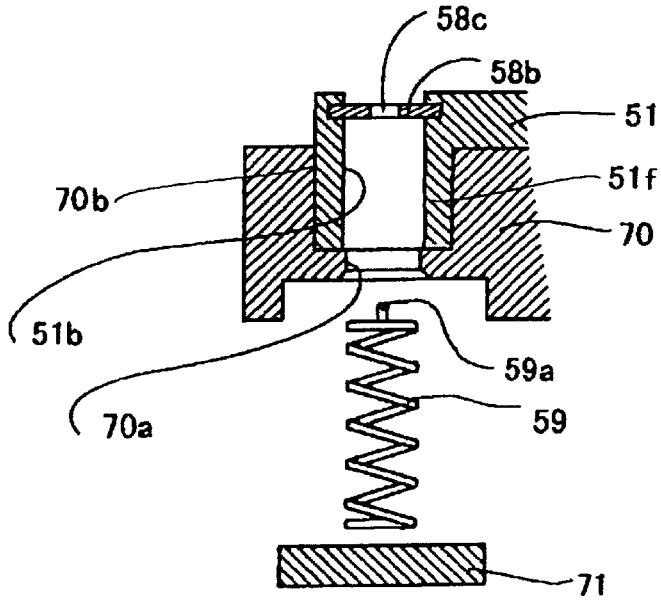
FIG. 7a PRIOR ART
FIGS. 7*a* and 7*b* are sectional views showing a method for assembling the coil spring.
Figure 7B:
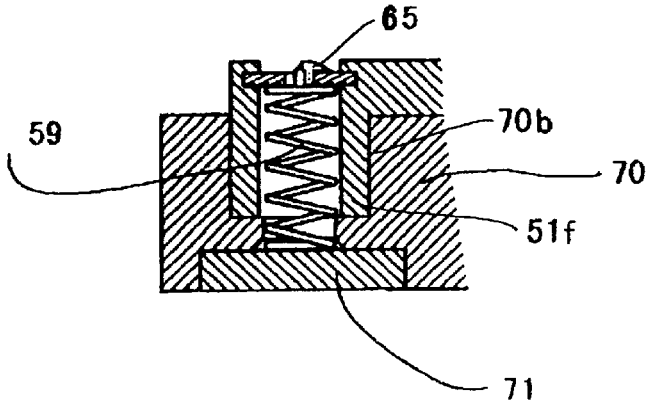
FIG. 7b PRIOR ART
Figure 8A:
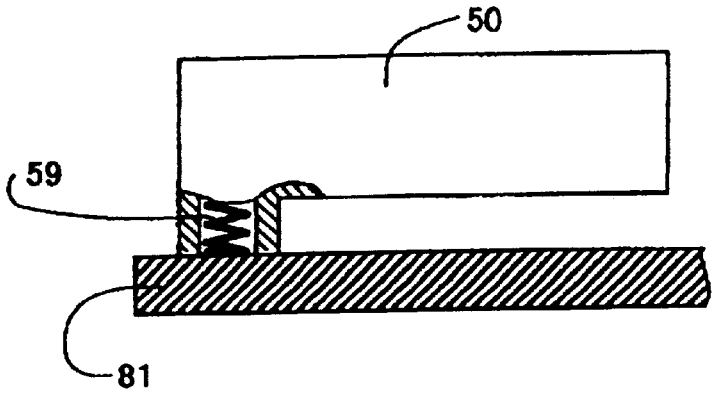
FIG. 8a PRIOR ART
FIGS. 8*a* and 8*b* show the mounting conditions of a portable telephone.
Figure 8B:
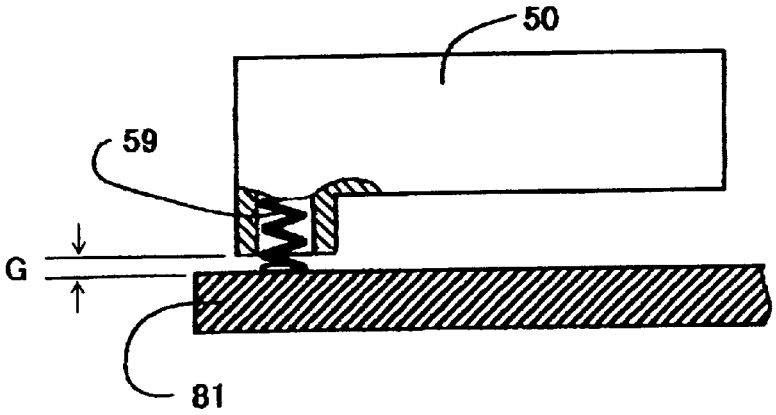
FIG. 8b PRIOR ART
Figure 9:
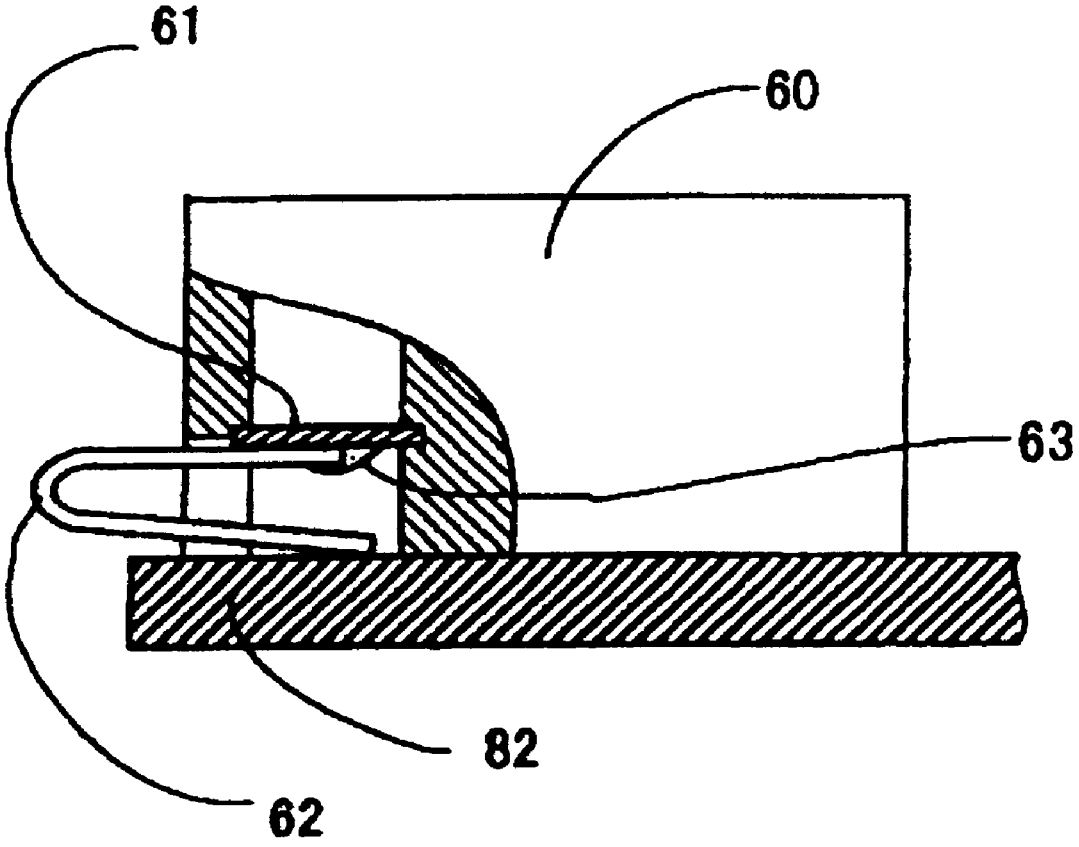
FIG. 9 PRIOR ART
FIG. 9 is a sectional view of another conventional connecting device.

Referring to FIG. 1 showing a sectional view of a sound generator of the present invention, the body of the sound generator has the same construction as the conventional sound generator showing in FIGS. 5 and 6. Namely, a case 1 of the electromagnetic sound generator 17 comprises an upper case 3 and a lower case 2.

An circular projection 2*a* and a pair of cylindrical projections 2*c* are formed on the lower case 2.

A yoke 4 having a core 4*a* and made of magnetic material is secured to the bottom of the lower case 2. An annular magnet 5 and a coil 6 are mounted on the yoke 4. An annular vibrating plate 7 having an armature 8 is secured on the circular projection 2*a*. Thus, a magnetic circuit for a buzzer is formed by the yoke 4, core 4*a*, magnet 5 ad vibrating plate 7.

A pair of a lead plates 9 are embedded in the lower case 2.

An end portion 9*a* of each of the lead plates 9 is exposed in a hole 26 in the cylindrical projection 2*c*. The other end of the lead plate 9 is connected to an end of the coil 6.

In accordance with the present invention, a terminal connecting device 10 is inserted in the hole 26 of the cylindrical projection 2*c* of the lower case 2.

Figure 2A:
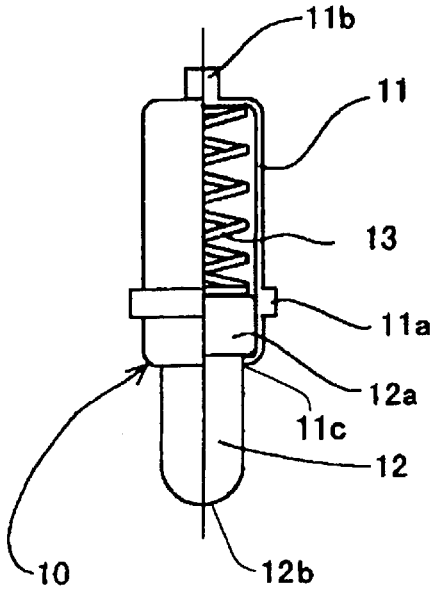
FIGS. 2*a* and 2*b* are sectional views of terminal connecting devices for external terminals.

Referring to FIG. 2*a*, the terminal connecting device 10 comprises a cylindrical case 11 and a connecting rod 12 which are made of metal. The connecting rod 12 has a spherical end 12*b* and a head 12*a* having a larger diameter than the rod 12 and is slidably engaged with the inside wall of the cylindrical case 11. An opening end of the cylindrical case 11 is narrowed to form a stopper edge 11*c*. A coil spring 13 is inserted in the cylindrical case 11, compressed between the closed top end and the head 12*a*. The connecting rod 12 is outwardly urged by the coil spring 13 and stopped by the engagement of the head 12*a* with the stopper edge 11*c*. A projection 11*b* is formed on the top end of the cylindrical case 11 and a flange 11*a* is formed at a lower portion of the case 11. Each component member 11, 12 and 13 is coated with gold plating.

Figure 3:
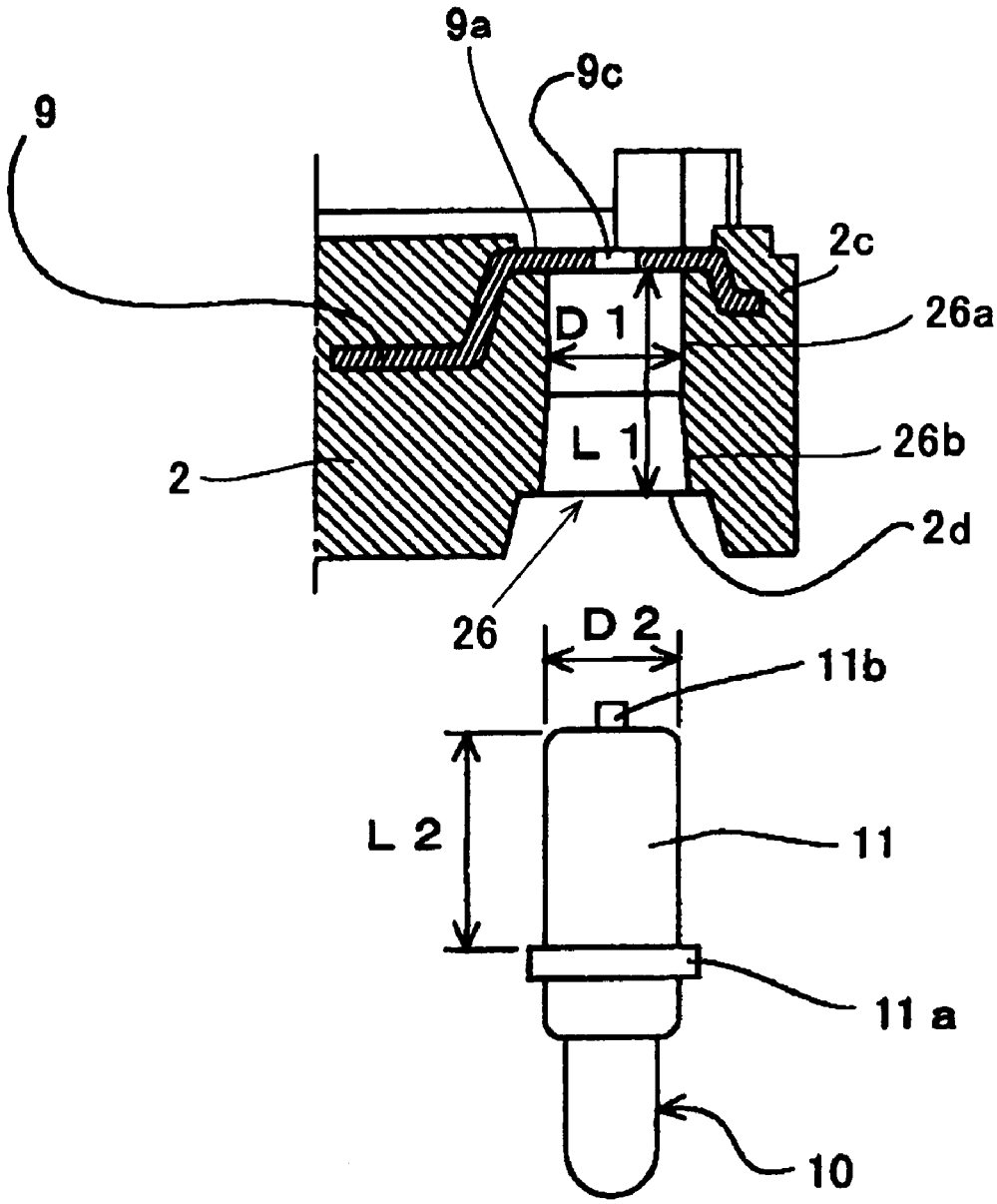
FIG. 3 is a sectional view for explaining the attaching of the connecting device.

Referring to FIG. 3, the hole 26 of the cylindrical projection 2*c* comprises an inner hole 26*a* having a diameter D1 and a taper hole 26*b*. The diameter D1 is slightly smaller than the diameter D2 of the cylindrical case 11, and the diameter at the opening end of the taper hole 26*b* is slightly larger than the diameter D2. The length L1 of the hole 26 is slightly shorter than the length L2 of the cylindrical case 11 between the top end of the cylindrical case and the flange 11*a*.

In order to insert the terminal connecting device 10 in the hole 26, first, the top end portion of the cylindrical case 11 is inserted in the opening end of the taper hole 26*b*. Next, a fork of a pressing jig pushes the flange 11*a* of the case until the flange pressed against a lower end face 2*d* of the cylindrical projection 2*c*. At the time, the projection 11*b* is inserted in a hole 9*c* of the end portion 9*a* of the lead plate 9. Since the length L1 of the hole 26 is shorter than the length L2 of the cylindrical case 11, the top end surface of the case 11 is strongly pressed against the end portion 9*a*. Thus, the case 11 is securely connected to the lead plate 9.

Figure 2B:
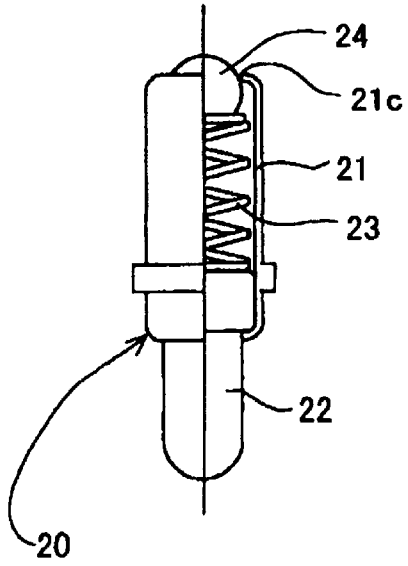

FIG. 2*b* shows another example of the terminal connecting device. The terminal connecting device 20 comprises a cylindrical case 21, connecting rod 22 and coil spring 23. The cylindrical case 21 further has a narrow opening end to form a stopper edge 21*c*. A ball 24 is provided in the case 21 and pressed against the stopper edge 21*c* by the coil spring 23.

When assembled in the hole 26 of the cylindrical projection 2*c*, the ball 24 is pressed against the peripheral edge of the hole 9*c* of the end portion 9*a* of the lead plate 9. Thus, the ball 24 and hence the terminal connecting device 20 is securely connected with the lead plate 9.

Since the projection 11 or the ball 24 can be observed from the hole 9*c*, the engagement of the terminal connecting device 10 or 20 with the lead plate 9 can be confirmed.

Figure 4A:
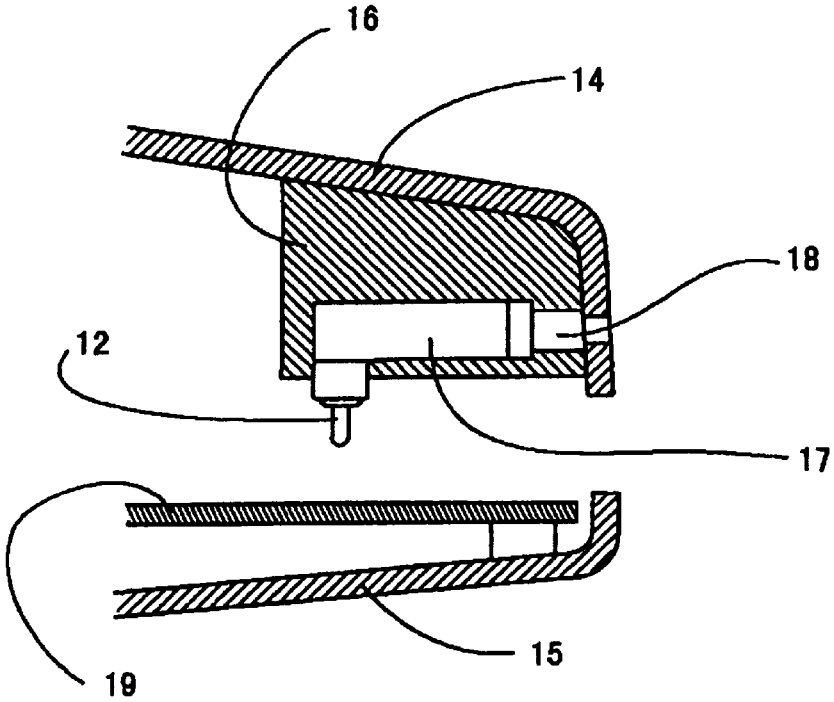
FIGS. 4*a* and 4*b* are sectional views showing the attaching of the sound generator to a portable telephone.
Figure 4B:
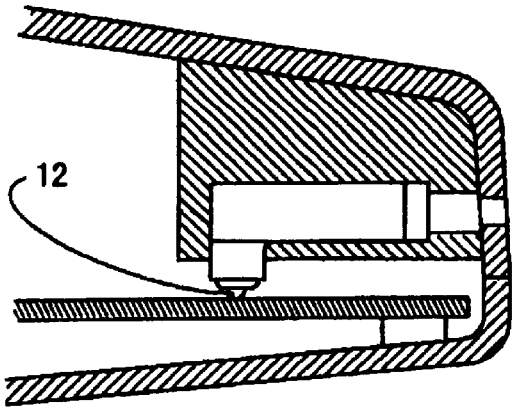

FIGS. 4*a* and 4*b* show assembling operation of the sound generator to a portable telephone. The portable telephone has an upper case 14 and a lower case 15. The electromagnetic sound generator 17 of the present invention is mounted in a gasket housing 16 provided in the upper case. A sound emanating hole 1*a* (FIG. 1) of the sound generator 17 is communicated with a sound emanating hole 18 of the upper case 14.

When the upper case 14 and the lower case 15 are combined with each other, the connecting rod 12 of the sound generator 17 is resiliently pressed against a terminal of a printed circuit board 19 in the lower case, while the connecting rod 12 is forced in the cylindrical case 11, compressing the coil spring 13 (23) as shown in FIG. 4*b*. Thus, the spherical end 12*b* of the connecting rod 12 is strongly pressed against the terminal of the circuit board 19 at a larger pressure (0.5 N–1.0 N), so that the sound generator 17 of the present invention is securely mounted in the portable telephone.

In accordance with the present invention, the terminal connecting device of the electromagnetic sound generator is pressed against the lead plate of the sound generator so as to connect the sound generator with the outside circuit board. Therefore, the terminal connecting device is connected to the sound generator without soldering. Furthermore, since the connecting rod of the terminal connecting device is resiliently pressed against the terminal of the circuit board, the sound generator and the electronic instrument are reliably connected with each other.

While the invention has been described in conjunction with preferred specific embodiment thereof, it will be understood that this description is intended to illustrate and not limit the scope of the invention, which is defined by the following claims.

What is claimed is:

1. An electromagnetic sound generator having a case provided with a yoke, a magnet, a vibrating plate and a coil, and a pair of leads, wherein an end portion of each of the leads is connected to an end of the coil and the other end portion of the lead is secured to the case and the underside of the other end portion is exposed, a terminal connecting device is provided for connecting the lead to an outside terminal, the terminal connecting device comprises a cylindrical case secured to the case, a connecting rod slidably mounted in the cylindrical case, a coil spring provided in the cylindrical case to outwardly urge the connecting rod so as to be contacted with the outside terminal at an end of the connecting rod, and means for contacting the cylindrical case with the exposed portion of other end portion of the lead.

2. The sound generator according to claim 1 wherein the means for contacting the cylindrical case is engagement of a projection of the cylindrical case with a hole formed in the other end of the lead so as to keep the contact of the cylindrical case with end of the lead.

3. The sound generator according to claim 1 wherein the means for contacting the cylindrical case comprises a ball provided in the cylindrical case so as to be outwardly urged by the coil spring to be contacted with an inside wall of a hole formed in the end of the lead.

* * * * *